US010304610B2

(12) United States Patent
Maeda

(10) Patent No.: US 10,304,610 B2
(45) Date of Patent: May 28, 2019

(54) COIL COMPONENT

(71) Applicant: MURATA MANUFACTURING CO., LTD., Kyoto-fu (JP)

(72) Inventor: Eiichi Maeda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 196 days.

(21) Appl. No.: 15/333,499

(22) Filed: Oct. 25, 2016

(65) Prior Publication Data

US 2017/0133143 A1 May 11, 2017

(30) Foreign Application Priority Data

Nov. 9, 2015 (JP) ..... 2015-219807

(51) Int. Cl.
*H01F 17/06* (2006.01)
*H01F 27/22* (2006.01)
(Continued)

(52) U.S. Cl.
CPC ..... *H01F 27/22* (2013.01); *H01F 1/0306* (2013.01); *H01F 17/04* (2013.01); *H01F 27/255* (2013.01);
(Continued)

(58) Field of Classification Search
USPC ..... 336/175
See application file for complete search history.

(56) References Cited

U.S. PATENT DOCUMENTS 7,170,378 B2 * 1/2007 Fujiwara ..... H01F 1/15366 148/304
8,054,149 B2 * 11/2011 Tung ..... H01F 17/04 336/110
(Continued)

FOREIGN PATENT DOCUMENTS

JP 2000-082629 A 3/2000
JP 2011-014822 A 1/2011
(Continued)

OTHER PUBLICATIONS

Notification of the First Office Action issued by the State Intellectual Property Office of the People's Republic of China on Jan. 23, 2018, which corresponds to Chinese Patent Application No. 201610987207.1 and is related to U.S. Appl. No. 15/333,499.
(Continued)

*Primary Examiner* — Ronald Hinson
(74) *Attorney, Agent, or Firm* — Studebaker & Brackett PC

(57) ABSTRACT

A coil component includes a coil portion, a core portion in which the coil portion is buried, and first and second outer electrodes connected respectively to one end and the other end of the coil portion at one or different end surfaces of the core portion. The core portion includes a metal magnetic substance—resin composite and a heat dissipative resin composite having a higher thermal conductivity than the metal magnetic substance—resin composite. The heat dissipative resin composite is arranged around an outer periphery of the coil portion to connect the outer periphery and the end surface of the core portion in at least parts thereof. The metal magnetic substance—resin composite is arranged in a core region and upper and lower regions with respect to the coil portion, and in a connecting region in at least one corner of the core portion.

7 Claims, 15 Drawing Sheets

(51) Int. Cl.

| | |
|---|---|
| ***H01F 1/03*** | (2006.01) |
| ***H01F 27/255*** | (2006.01) |
| ***H01F 27/29*** | (2006.01) |
| ***H01F 41/02*** | (2006.01) |
| ***H01F 41/10*** | (2006.01) |
| ***H01F 17/04*** | (2006.01) |

(52) U.S. Cl.
CPC ..... *H01F 27/292* (2013.01); *H01F 41/0246* (2013.01); *H01F 41/10* (2013.01); *H01F 2017/048* (2013.01)

(56) References Cited

U.S. PATENT DOCUMENTS

| | | | | |
|---|---|---|---|---|
| 9,117,580 | B2 * | 8/2015 | Wu | H01F 3/08 |
| 9,659,705 | B2 * | 5/2017 | Muneuchi | H01F 41/005 |
| 2003/0001718 | A1 * | 1/2003 | Inoue | H01F 1/24 338/32 R |
| 2010/0259353 | A1 * | 10/2010 | Saito | H01F 27/292 336/205 |
| 2014/0062638 | A1 * | 3/2014 | Sasamori | H01F 27/2847 336/175 |
| 2014/0062639 | A1 * | 3/2014 | Sasamori | H01F 17/04 336/175 |
| 2016/0343501 | A1 * | 11/2016 | Suzuki | H01F 27/2828 |

FOREIGN PATENT DOCUMENTS

| | | | |
|---|---|---|---|
| JP | 2012-039098 | A | 2/2012 |
| JP | 2012-248630 | A | 12/2012 |
| JP | 2014-225590 | A | 12/2014 |
| JP | 2015-126202 | A | 7/2015 |

OTHER PUBLICATIONS

An Office Action; "Notification of Reasons for Refusal," mailed by the Japanese Patent Office dated Jun. 5, 2018, which corresponds to Japanese Patent Application No. 2015-219807 and is related to U.S. Appl. No. 15/333,499; with English language translation.

* cited by examiner

COIL COMPONENT

CROSS REFERENCE TO RELATED APPLICATIONS

This application claims benefit of priority to Japanese Patent Application 2015-219807 filed Nov. 9, 2015, the entire content of which is incorporated herein by reference.

TECHNICAL FIELD

The present disclosure relates to a coil component.

BACKGROUND

Hitherto, there is known a coil component (composite coil), such as an impedance element or an inductance element, in which a coil formed by winding a conductive wire is incorporated in a core portion containing metal magnetic substance powder and resin.

For example, Japanese Unexamined Patent Application Publication No. 2014-225590 discloses a manufacturing method for a surface-mounted inductor, the manufacturing method including the steps of winding a conductive wire to form a coil, forming a core portion incorporating the coil with use of an encapsulation material, which is made of mainly metal magnetic substance powder and resin, such that at least parts of both end portions of the coil are exposed at surfaces of the core portion, setting smoothness of a surface of at least part of a region of the core portion where an outer electrode is formed to be lower than smoothness of a surface around the former surface, and forming the outer electrode in the core portion to be electrically conducted to the coil.

The core portion containing the metal magnetic substance powder and the resin tends to have a smaller thermal conductivity. This is attributable to the fact that the thermal conductivity of the metal magnetic substance powder is comparatively small. When the thermal conductivity of the core portion is small, there is a tendency that heat is less apt to dissipate to the outside on the occurrence of heating of the coil (so-called copper loss) and/or the occurrence of heating of the metal magnetic substance powder contained in the core portion (so-called iron loss), and that temperature of the coil component increases. A temperature rise of the coil component is apt to cause malfunction of an IC, etc. disposed near the core portion, and/or heating of an electronic device that includes the coil component. For that reason, an improvement in heat dissipation characteristics of the core portion is demanded.

On the other hand, the coil component is demanded to have a higher inductance value (L value).

SUMMARY

Accordingly, it is an object of the present disclosure to provide a coil component having good heat dissipation characteristics and a high inductance value, and a manufacturing method for the coil component.

As a result of intensively conducting studies with intent to achieve the above-mentioned object, the inventor has accomplished the present disclosure by finding the fact that, when a metal magnetic substance—resin composite and a heat dissipative resin composite having a higher thermal conductivity than the metal magnetic substance—resin composite are arranged at a particular position inside the coil component, heat dissipation characteristics of the coil component can be improved and a high inductance value can be obtained together.

According to a first preferred embodiment of the present disclosure, there is provided a coil component including a coil portion, a core portion in which the coil portion is buried, a first outer electrode connected to one end of the coil portion at an end surface of the core portion, and a second outer electrode connected to the other end of the coil portion at an end surface of the core portion, wherein the core portion includes a metal magnetic substance—resin composite and a heat dissipative resin composite having a higher thermal conductivity than the metal magnetic substance—resin composite, the heat dissipative resin composite is arranged in a state surrounding an outer periphery of the coil portion and connecting the outer periphery of the coil portion and at least one of end surfaces of the core portion in at least parts thereof, and the metal magnetic substance—resin composite is arranged in a core region of the coil portion, an upper region and a lower region above and under the coil portion, and a connecting region that connects the upper region and the lower region to each other in at least one corner of the core portion.

According to a second preferred embodiment of the present disclosure, there is provided a manufacturing method for the above coil component, the manufacturing method including the steps of preparing a forming die provided with, on a surface thereof, a first positioning pin for positioning the coil portion and a second positioning pin for positioning the connecting region, inserting the coil portion over the first positioning pin, press-fitting a heat dissipative resin composite sheet under heating from above the coil portion such that the heat dissipative resin composite is arranged in a state surrounding the outer periphery of the coil portion, press-fitting a metal magnetic substance—resin composite sheet under heating from above the coil portion while the first positioning pin and the second positioning pin are withdrawn downward, such that the metal magnetic substance—resin composite is arranged in the core region of the coil portion, the upper region above the coil portion, and the connecting region, press-fitting another metal magnetic substance—resin composite sheet under heating to the lower region under the coil portion, thus obtaining a block structural body, cutting the block structural body into pieces each having a predetermined size, thus forming the core portion including the coil portion with both ends thereof exposed at end surfaces respectively of the core portion, and forming, on the end surfaces of the core portion, a first outer electrode connected to one end of the coil portion and a second outer electrode connected to the other end of the coil portion.

With the features described above, the coil component according to the one preferred embodiment of the present disclosure has good heat dissipation characteristics and a high inductance value. Furthermore, with the features described above, the manufacturing method for the coil component, according to the other preferred embodiment of the present disclosure, can manufacture the coil component having the good heat dissipation characteristics and the high inductance value.

Other features, elements, characteristics and advantages of the present disclosure will become more apparent from the following detailed description of preferred embodiments of the present disclosure with reference to the attached drawings.

DETAILED DESCRIPTION

Figure 1:
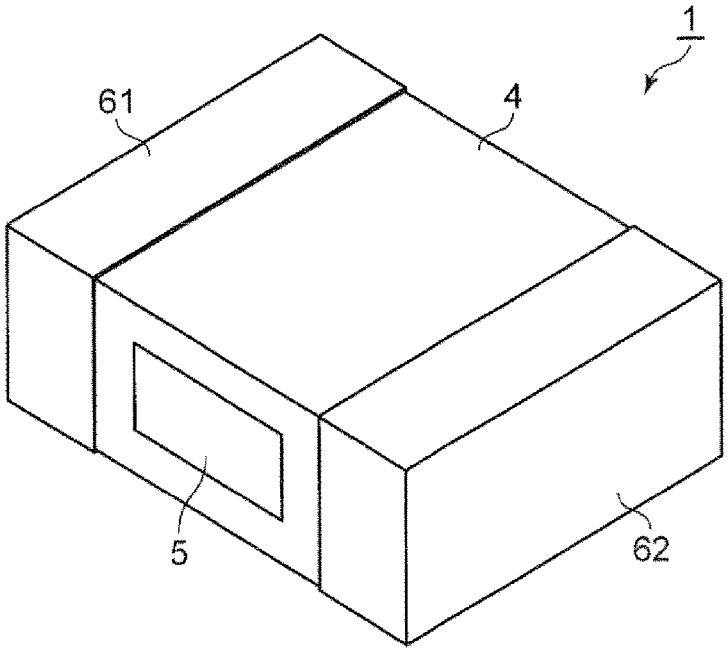
FIG. 1 is a perspective view of a coil component according to one embodiment of the present disclosure.

An embodiment of the present disclosure will be described below with reference to the drawings. It is to be noted that the following embodiment is intended to explain the present disclosure by way of example, and that the present disclosure is not limited to the following embodiment. Sizes, materials, shapes, relative layouts, etc. of constituent elements in the following description are not purported to limit the scope of the present disclosure thereto unless otherwise specified, and they are merely illustrative examples. In addition, the sizes, the shapes, the relative layouts, etc. of the constituent elements illustrated in the drawings are intentionally exaggerated in some cases for clearer understanding of the description.

Coil Component

A coil component according to one embodiment of the present disclosure is illustrated in FIGS. 1 to 7. The coil component 1 according to the embodiment includes a coil portion 2 that is forming by winding a conductive wire, a core portion 3 in which the coil portion 2 is buried, a first outer electrode 61 connected to one end of the coil portion 2 at an end surface of the core portion 3, and a second outer electrode 62 connected to the other end of the coil portion 2 at an end surface of the core portion 3, which is different from the above end surface.

Figure 2:
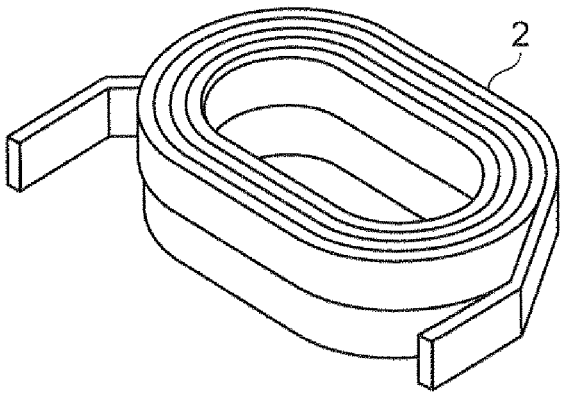
FIG. 2 is a perspective view of a coil portion according to the one embodiment of the present disclosure.

The coil portion 2 is just required to be a conductor in the form of a coil. The coil portion 2 is formed, for example, by winding a copper wire. The conductive wire may be, e.g., a round wire having a circular sectional shape, or a rectangular wire having a rectangular sectional shape. When the rectangular wire is used as the conductive wire, a ratio of a cross-sectional area of the conductor to a cross-sectional area of the coil portion 2 can be increased in comparison with the case of using the round wire. Thus, the rectangular wire is more preferable from the viewpoint of enabling size reduction and higher performance of the coil component 1 to be realized together. As illustrated in FIG. 2, the conductive wire is preferably wound by a winding. Size reduction and a higher inductance value of the coil component 1 can be realized together with use of the conductive wire wound by a winding. Alternatively, the coil portion 2 may be formed by patterning a metal foil into the shape of a coil. As an alternative, the coil portion 2 may be formed by coating or applying a metal paste into the shape of a coil.

Figure 3:
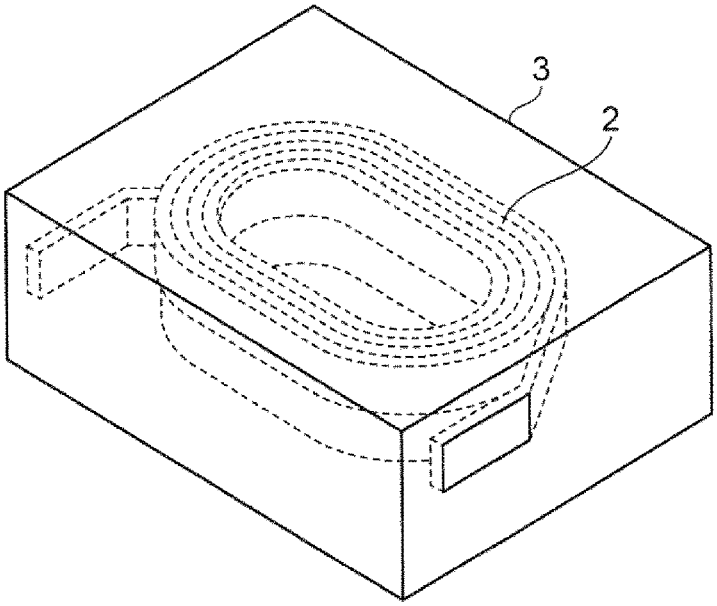
FIG. 3 is a perspective view of a core portion in the coil component illustrated in FIG. 1, the view being drawn in a seeing-through way.

The coil portion 2 is buried in the core portion 3. In this embodiment, the coil portion 2 is buried in the core portion 3, as illustrated in FIG. 3, such that both ends of the coil portion 2 are exposed at the end surfaces of the core portion 3. The core portion 3 includes a metal magnetic substance—resin composite 4 containing metal magnetic substance powder and resin, and a heat dissipative resin composite 5 having a higher thermal conductivity than the metal magnetic substance—resin composite 4. A metal magnetic substance contained in the metal magnetic substance—resin composite 4 is advantageous in having a higher saturated magnetic flux density and better direct-current superposition characteristics than ferrite.

The heat dissipative resin composite 5 is arranged in a state surrounding an outer periphery of the coil portion 2 and connecting the outer periphery of the coil portion 2 and the end surface of the core portion 3 in at least parts thereof. Stated in another way, as illustrated in FIG. 1, a part of the heat dissipative resin composite 5 is exposed at the end surface of the core portion 3. In this embodiment, as illustrated in FIGS. 4 to 7, the heat dissipative resin composite 5 is arranged in a state surrounding the outer periphery of the coil portion 2 and connecting the outer periphery of the coil portion 2 and both lateral surfaces of the core portion 3. The heat dissipative resin composite 5 has a higher thermal conductivity than the metal magnetic substance—resin composite 4.

When a current is applied to the coil component 1, heating of the coil portion 2 (copper loss) and heating of the metal magnetic substance powder (iron loss) occur. A temperature rise of the coil component 1 with those two types of heating is apt to cause malfunction of an IC, etc. disposed near the coil component, and/or heating of an electronic device that includes the coil component. In the coil component 1 according to this embodiment, since the heat dissipative resin composite 5 having a comparatively high thermal conductivity is arranged as described above, the heating of the coil portion 2 (copper loss) and the heating of the metal magnetic substance powder (iron loss) can be dissipated to the outside from the end surfaces of the core portion 3 through the heat dissipative resin composite 5. As a result, the coil component 1 can exhibit good heat dissipation characteristics. The metal magnetic substance has a smaller electric resistance than ferrite, and hence tends to generate a larger loss. Therefore, an effect obtained with an improvement of the heat dissipation characteristics is particularly significant in the coil component according to the present disclosure, which employs the metal magnetic substance.

The heat dissipative resin composite 5 contains filler and resin. The heat dissipative resin composite 5 preferably contains filler having a comparatively high thermal conductivity, e.g., filler having a thermal conductivity of not less than about 10 W/mK. More specifically, one or more types of filler selected from a group consisting of metal oxides such as alumina (aluminum oxide), metal nitrides such as aluminum nitride and silicon nitride, and CNT (carbon nano-tube) can be used. The heat dissipative resin composite 5 may further contain, in addition to the above-described filler, thermosetting resin such as epoxy resin, silicone resin, phenol resin, urethane resin, or polyimide resin, or thermoplastic resin such as polyethylene or PPS (polyphenylene sulfide). The heat dissipative resin composite 5 preferably contains epoxy resin. On the other hand, when the core portion 3 is formed by injection molding, the heat dissipative resin composite 5 may contain thermoplastic resin.

The content of the filler in the heat dissipative resin composite is not particularly limited insofar as the content is within a range where the thermal conductivity of the heat dissipative resin composite is larger than that of the metal magnetic substance—resin composite. The content of the filler can be optionally adjusted depending on the types of the filler and the resin used in practice. For example, when alumina is used as the filler and epoxy resin is used as the resin, the content of the filler in the heat dissipative resin composite is preferably not less than about 50% by volume and not more than about 90% by volume. When the content of the filler is not less than about 50% by volume, the heat dissipation characteristics of the coil component can be further improved. When the content of the filler is not more than about 90% by volume, workability can be improved. More preferably, the content of the filler in the heat dissipative resin composite is not less than about 65% by volume and not more than about 75% by volume. When the content of the filler in the heat dissipative resin composite is within the above-mentioned more preferable range, it is possible to satisfactorily obtain both the heat dissipation characteristics of the coil component and the workability in forming the heat dissipative resin composite.

Figure 4:
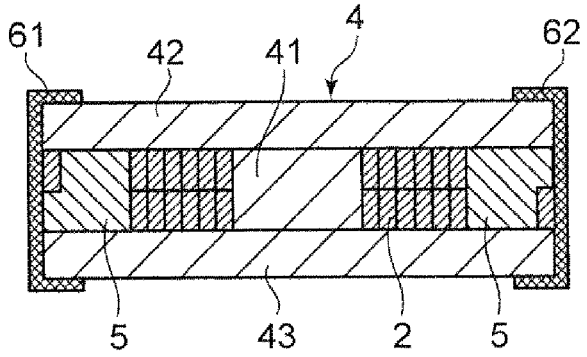
FIG. 4 is a schematic sectional view of the coil component illustrated in FIG. 1, the view being taken in a vertical direction.

The metal magnetic substance—resin composite 4 contains the metal magnetic substance powder and the resin. As illustrated in FIG. 4, the metal magnetic substance—resin composite 4 is arranged in a core region 41 of the coil portion and in an upper region 42 and a lower region 43 above and under the coil portion 2. The metal magnetic substance—resin composite 4 is further arranged in a connecting region that connects the upper region 42 and the lower region 43 to each other in at least one corner of the core portion 3. In the coil component 1 according to this embodiment, as illustrated in FIGS. 5 to 7, the metal magnetic substance—resin composite 4 is arranged in connecting regions 44 that connect the upper region 42 and the lower region 43 to each other at four corner of the core portion 3.

Figure 7:
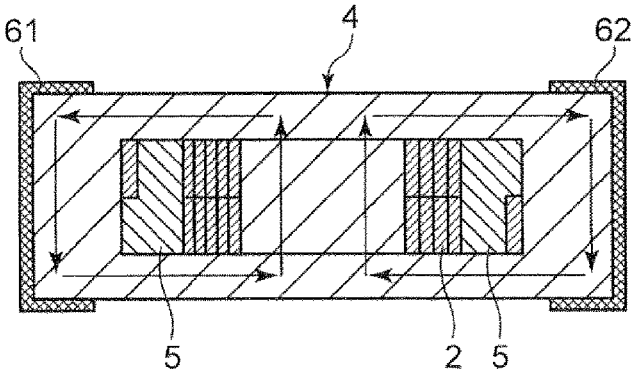
FIG. 7 is a schematic sectional view of the coil component illustrated in FIG. 5, the view being taken along the line 7-7.

In the coil component 1 according to this embodiment, with the metal magnetic substance—resin composite 4 being arranged as described above, when a current is applied to the coil component 1, magnetic flux is able to flow in a way of, as illustrated in FIG. 7, reaching the corners of the core portion 3 after starting from a magnetic core (i.e., the core region 41) and passing through the upper region 42 above the coil portion 2 (or the lower region 43 under the coil portion 2), passing through the connecting regions 44, and then coming back to the magnetic core (i.e., the core region 41) after passing through the lower region 43 under the coil portion 2 (or the upper region 42 above the coil portion 2). In FIG. 7, streams of the magnetic flux flowing in the coil component 1 (i.e., a magnetic circuit) are denoted by arrows. A high inductance value (L value) can be obtained by continuously arranging the metal magnetic substance—resin composite 4, as described above, such that the magnetic circuit is not cut off by the heat dissipative resin composite 5. As a result, the coil component 1 can realize good heat dissipation characteristics and the high L value together.

Figure 5:
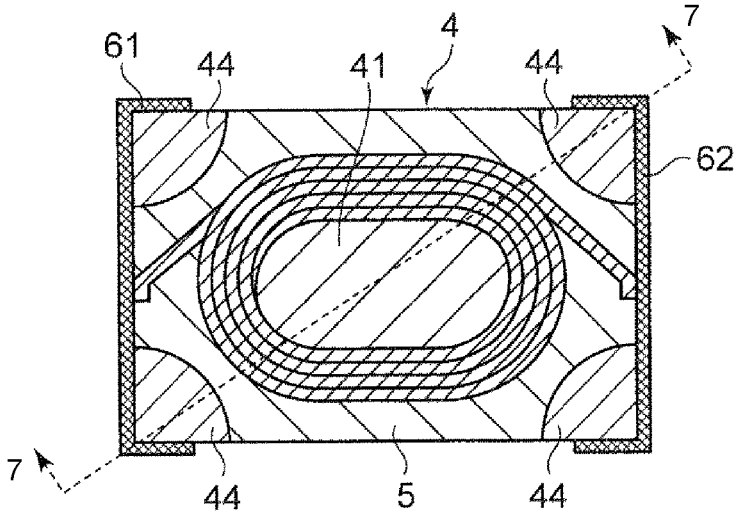
FIG. 5 is a schematic sectional view of the coil component illustrated in FIG. 1, the view being taken in a horizontal direction.
Figure 6:
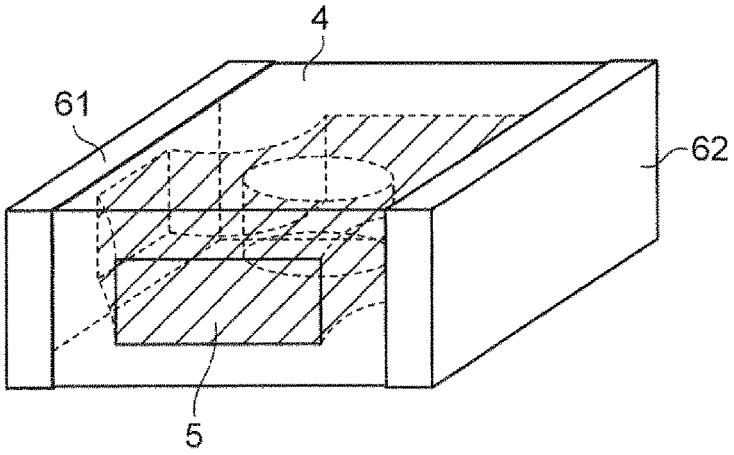
FIG. 6 is a perspective view of the coil component illustrated in FIG. 1, the view being drawn in a seeing-through way.

As illustrated in FIGS. 5 and 6, the metal magnetic substance—resin composite 4 is preferably arranged in the connecting regions 44 that connect the upper region 42 and the lower region 43 to each other at the four corners of the core portion 3. As a result of arranging the metal magnetic substance—resin composite 4 at the four corners (i.e., in the four connecting regions 44), it is possible to improve the heat dissipation characteristics and the inductance value of the coil component 1, and to achieve size reduction of the coil component 1. Note that the number of the connecting regions is not limited to four, and that the core portion 3 may include the metal magnetic substance—resin composite 4 arranged in any desired number of the connecting regions 44.

As a difference between a cross-sectional area, taken in a horizontal direction, of the core region 41 where the metal magnetic substance—resin composite 4 is arranged and a cross-sectional area, taken in the horizontal direction, of the connecting region 44 decreases, the magnetic flux flowing in the coil component 1 is less likely to be impeded, and characteristics of the coil component 1 are further improved. Therefore, respective values of the above-mentioned cross-sectional areas are preferably set such that the difference between the horizontal cross-sectional area of the core region and the horizontal cross-sectional area of the connecting region 44 has a smaller value. More specifically, a ratio of the horizontal cross-sectional area of the connecting region 44 to the horizontal cross-sectional area of the core region 41 is preferably not less than about 100% and not more than about 120%. By setting the ratio of the horizontal cross-sectional area of the connecting region 44 to the horizontal cross-sectional area of the core region 41 to be not less than about 100%, the heat dissipation characteristics of the coil component can be improved. By setting the ratio of the horizontal cross-sectional area of the connecting region 44 to the horizontal cross-sectional area of the core region 41 to be not more than about 120%, the magnetic flux can be allowed to pass through the connecting region 44 with higher efficiency. More preferably, the ratio of the horizontal cross-sectional area of the connecting region 44 to the horizontal cross-sectional area of the core region 41 is preferably not less than about 100% and not more than about 110%. Even more preferably, the horizontal cross-sectional area of the connecting region 44 is substantially the same as that of the core region 41. When the metal magnetic substance—resin composite is arranged in two or more connecting regions, a total of horizontal cross-sectional areas of the two or more connecting regions preferably falls within the above-mentioned numerical range.

The metal magnetic substance powder usable in the metal magnetic substance—resin composite 4 is not limited to a particular one, and suitable metal magnetic substance powder can be optionally used depending on practical applications. The metal magnetic substance powder contained in the metal magnetic substance—resin composite 4 is just required to be powder of Fe or powder of an amorphous material containing Fe. The metal magnetic substance—resin composite 4 may contain, for example, powder of one or more types of metal magnetic substances selected from a group consisting of Fe, a FeSiCr alloy, a FeSi alloy, and amorphous FeSiCrB. A particle diameter of the metal magnetic substance powder is not limited to a particular value. The metal magnetic substance powder may be a mixture of two or more types of powder different in particle size distribution. In other words, the particle size distribution of the metal magnetic substance powder may have two or more peaks. With the particle size distribution of the metal magnetic substance powder having two or more peaks, the content of the metal magnetic substance powder in the metal magnetic substance resin composite 4 can be increased.

The resin usable in the metal magnetic substance resin composite 4 is not limited to a particular one, and suitable resin can be optionally used depending on practical applications. The metal magnetic substance—resin composite 4 may contain thermosetting resin such as epoxy resin, silicone resin, phenol resin, or polyimide resin, or thermoplastic resin such as polyethylene or PPS (polyphenylene sulfide). The metal magnetic substance—resin composite 4 preferably contains epoxy resin. On the other hand, when the core portion 3 is formed by injection molding, the metal magnetic substance—resin composite 4 may contain thermoplastic resin.

The content of the metal magnetic substance powder in the metal magnetic substance—resin composite 4 is preferably not less than about 50% by volume and not more than about 95% by volume. As the content of the metal magnetic substance powder increases, the inductance value of the coil component 1 further increases. When the content of the metal magnetic substance powder is not more than about 95% by volume, good workability is obtained.

The metal magnetic substance—resin composites arranged in the core region 41 of the coil portion 2, the upper region 42 and the lower region 43 above and under the coil portion 2, and the connecting region 44 between the upper region and the lower region 43 may have different compositions or the same composition. The metal magnetic substance—resin composites arranged in the core region 41 of the coil portion 2, the upper region 42 and the lower region 43 above and under the coil portion 2, and the connecting region 44 between the upper region 42 and the lower region 43 may be formed integrally or separately.

The layout of the outer electrodes (i.e. the first outer electrode 61 and the second outer electrode 62) in the coil component 1 according to this embodiment is illustrated in FIGS. 1, 4 and 5. The first outer electrode 61 is connected to one end of the coil portion 2 at an end surface of the core portion 3, and the second outer electrode 62 is connected to the other end of the coil portion 2 at a different end surface or the above-mentioned end surface of the core portion 3. Thus, the first outer electrode 61 and the second outer electrode 62 may be arranged at different end surfaces of the core portion 3 as illustrated in FIGS. 1, 4 and 5, or at the same end surface of the core portion 3 as illustrated in FIG. 10B as described later.

Modifications of the coil component 1 according to this embodiment will be described below with reference to the drawings. It is to be noted that, in the following modifications, description of the matters common to those in the above configurations is omitted, and only different points are described. In particular, although similar advantageous effects to those obtained with similar features are not stated in detail in the following modifications, similar advantageous effects to those obtained with the above-described features are obtained unless otherwise specified.

Figure 8A:
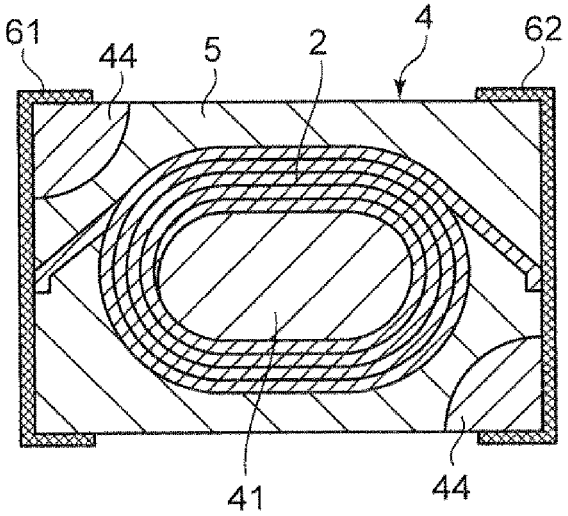
FIG. 8A is a schematic sectional view of a first modification of the coil component according to the one embodiment of the present disclosure, the view being taken in a horizontal direction.

FIG. 8A illustrates a first modification of the coil component 1 according to this embodiment. As illustrated in FIG. 8A, the metal magnetic substance—resin composite 4 may be arranged in two connecting regions 44 that are arranged at two corners of the core portion 3. Even with the metal magnetic substance—resin composite 4 arranged as described above, the heat dissipation characteristics can be improved by connecting the coil portion 2 and the end surfaces of the core portion 3 through the heat dissipative resin composite 5, and the metal magnetic substance—resin composite 4 can be arranged such that a magnetic path is not cut off by the heat dissipative resin composite 5. While, in this modification, the two connecting regions 44 are arranged at opposing corners of the core portion 3, the two connecting regions 44 may be arranged at adjacent corners of the core portion 3. Alternatively, the metal magnetic substance—resin composite may be arranged in three connecting regions that connect the metal magnetic substance—resin composite arranged in the upper region 42 above the coil portion 2 and the metal magnetic substance—resin composite arranged in the lower region 43 under the coil portion 2 to each other at three corners of the core portion 3.

Figure 8B:
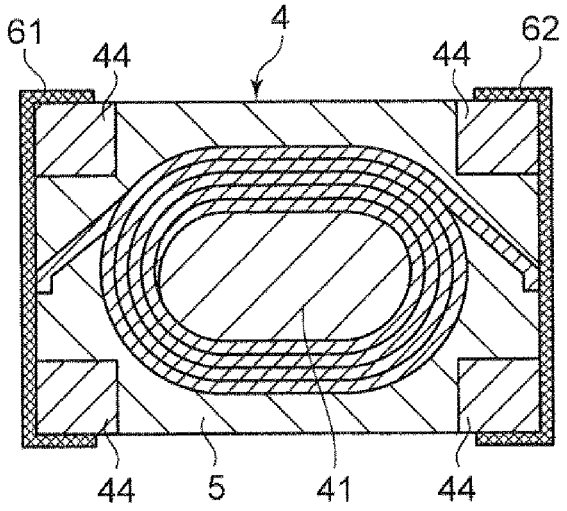
FIG. 8B is a schematic sectional view of a second modification of the coil component according to the one embodiment of the present disclosure, the view being taken in a horizontal direction.

FIG. 8B illustrates a second modification of the coil component 1 according to this embodiment. A horizontal cross-sectional shape of the connecting region 44 may be substantially rectangular as illustrated in FIG. 8B. It is to be noted here that the horizontal cross-sectional shape of the connecting region is not limited to a substantially sector-like shape illustrated in FIG. 5 or the substantially rectangular shape illustrated in FIG. 8B. The horizontal cross-sectional shape of the connecting region 44 may have any desired shape insofar as the magnetic path between the metal magnetic substance—resin composite arranged in the upper region 42 above the coil portion 2 and the metal magnetic substance—resin composite arranged in the lower region 43 under the coil portion 2 is ensured, and insofar as the heat dissipative resin composite 5 is arranged to be able to connect at least respective parts of the outer periphery of the coil portion 2 and the end surface(s) of the core portion 3 to each other. When the core portion 3 includes two or more connecting regions, horizontal cross-sectional shapes and cross-sectional areas of the connecting regions may be different from one another, or may be the same.

Figure 9A:
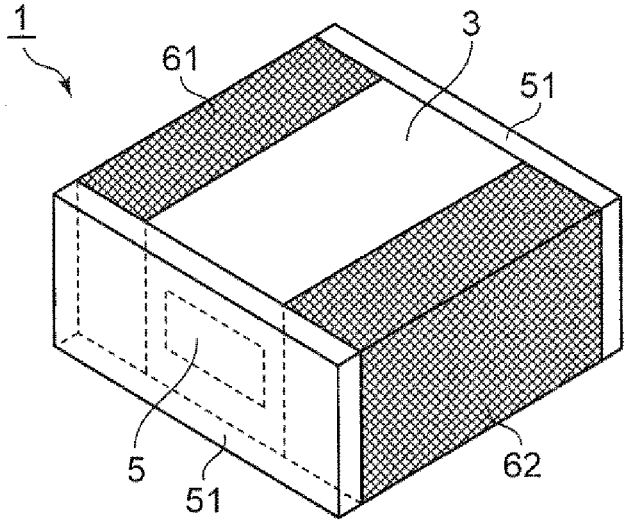
FIG. 9A is a perspective view of a third modification of the coil component according to the one embodiment of the present disclosure, the view being drawn in a seeing-through way.

FIG. 9A illustrates a third modification of the coil component according to this embodiment. In the coil component 1 illustrated in FIG. 9A, the heat dissipative resin composite connects the coil portion (not illustrated) and two end surfaces of the core portion 3. Thus, the heat dissipative resin composite is exposed at the two end surfaces of the core portion (an exposed portion of the heat dissipative resin composite in the one end surface is denoted by reference sign 5 in FIG. 9A). Furthermore, as illustrated in FIG. 9A, a heatsink member 51 may be disposed on one or more end surfaces of the core portion 3, the one or more end surfaces including the end surface that is connected to the outer periphery of the coil portion 2 through the heat dissipative resin composite 5. The heatsink member 51 is constituted by the same heat dissipative resin composite as mentioned above. In the configuration illustrated in FIG. 9A, the heatsink member 51 is arranged on two among the end surfaces of the core portion 3, those two being connected to the outer periphery of the coil portion 2 through the heat dissipative resin composite. With the provision of the heatsink member 51 arranged as described above, the heat dissipation characteristics of the coil component 1 can be further improved.

Figure 9B:
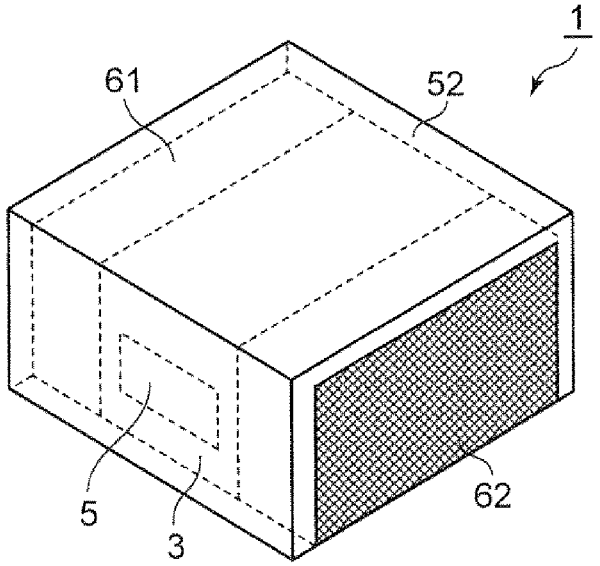
FIG. 9B is a perspective view of a fourth modification of the coil component according to the one embodiment of the present disclosure, the view being drawn in a seeing-through way.

FIG. 9B illustrates a fourth modification of the coil component according to this embodiment. The coil component 1 illustrated in FIG. 9B is different from the coil component according to the third modification, illustrated in FIG. 9A, in that heatsink members 52 are arranged at three in total among the end surfaces of the core portion 3, i.e., at the two end surfaces connected to the outer periphery of the coil portion through the heat dissipative resin composite and an upper surface of the core portion 3. With the provision of the heatsink members 52 arranged as described above, the heat dissipation characteristics of the coil component 1 can be even further improved.

The layout of the above heatsink members is not limited to the examples described in the modifications illustrated in FIGS. 9A and 9B. As an alternative, the heatsink member may be arranged only on one of the end surfaces of the core portion 3, the one being connected to the outer periphery of the coil portion through the heat dissipative resin composite. From the viewpoint of improving the heat dissipation characteristics, the heatsink member is preferably arranged over the entirety of the end surface of the core portion 3 as illustrated in FIGS. 9A and 9B. However, the heat dissipative resin composite may be arranged only on a part of the end surface of the core portion 3 when the heat dissipative resin composite 5 exposed at the relevant end surface of the core portion 3 is contacted with the heatsink member.

Figure 10A:
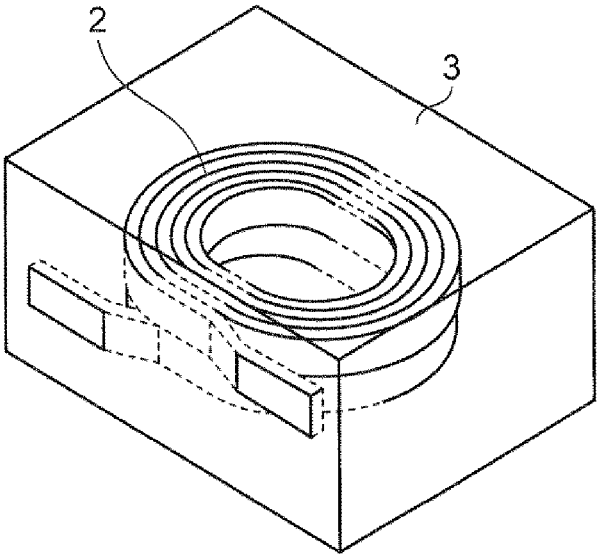
FIG. 10A is a perspective view of a fifth modification of the coil component according to the one embodiment of the present disclosure, the view being drawn in a seeing-through way.
Figure 10B:
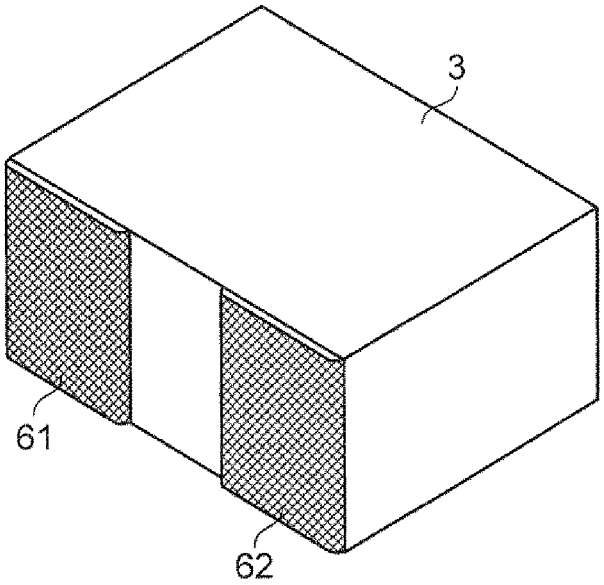
FIG. 10B is a perspective view of the fifth modification of the coil component according to the one embodiment of the present disclosure.

FIGS. 10A and 10B illustrate a fifth modification of the coil component according to this embodiment. The coil component 1 according to the fifth modification has a structure in which, as illustrated in FIG. 10A, both the ends of the coil portion 2 are exposed at one end surface of the core portion 3, the structure being different from the structure, illustrated in FIG. 3, in which both the ends of the coil portion 2 are exposed at different end surfaces of the core portion 3. In the coil component 1 according to the fifth modification, since both of the ends of the coil portion 2 are exposed at different end surfaces of the core portion 3, the first outer electrode 61 and the second outer electrode 62 can be arranged at the one end surface of the core portion 3, as illustrated in FIG. 10B. In the seeing-through perspective view of the core portion 3 illustrated in FIG. 10A, the layout of the metal magnetic substance—resin composite and the heat dissipative resin composite both included in the core portion 3 is not depicted. In the coil component according to the fifth modification as well, however, the metal magnetic substance—resin composite and the heat dissipative resin composite can be arranged in similar manners to those described in the above-described examples. As a result, good heat dissipation characteristics and a high inductance value can be obtained.

Manufacturing Method for Coil Component

A manufacturing method for the coil component, according to one embodiment of the present disclosure, will be described below with reference to FIGS. 11 and 12A to 12F. It is to be noted that the manufacturing method described below is merely illustrative, and that the manufacturing method for the coil component, according to the present disclosure, is not limited to the following method.

According to the one embodiment, the manufacturing method for the coil component includes a step of preparing a forming die provided with a positioning pin, a step of inserting the coil portion over the positioning pin, a step of arranging the heat dissipative resin composite, and a step of arranging the metal magnetic substance—resin composite in the core region of the coil portion, the upper region above the coil portion, and the connecting region, a step of forming the metal magnetic substance—resin composite in the lower region under the coil portion, a step of forming the core portion, and a step of forming the outer electrodes.

Figure 11:
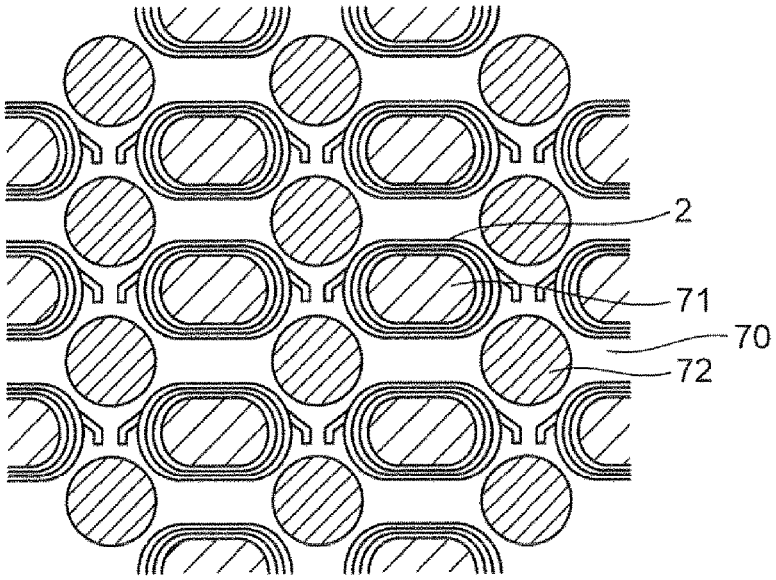
FIG. 11 is an explanatory view referenced to explain one example of a manufacturing method for the coil component according to the one embodiment of the present disclosure.

First, a forming die 70 provided with, on its surface, first positioning pins 71 for positioning the coil portions 2 and second positioning pins 72 for positioning the connecting regions 44 is prepared. FIG. 11 is a plan view of the forming die 70 in a state where the coil portions 2 are each inserted in place. Respective shapes and layouts of the first positioning pins 71 and the second positioning pins 72 can be optionally set depending on the shape of the coil portions 2 used, the layout and the shape of the connecting regions, etc. The first positioning pins 71 and the second positioning pins 72 are each constituted to be able to move in the up-down direction relative to the forming die 70.

The coil portions 2 are each inserted, as illustrated in FIG. 11, over the first positioning pin 71 on the forming die 70.

Figure 12A:
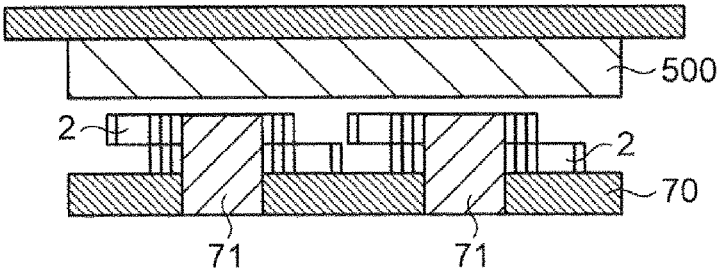
FIGS. 12A to 12F are explanatory views referenced to explain the one example of the manufacturing method for the coil component according to the one embodiment of the present disclosure.
Figure 12B:
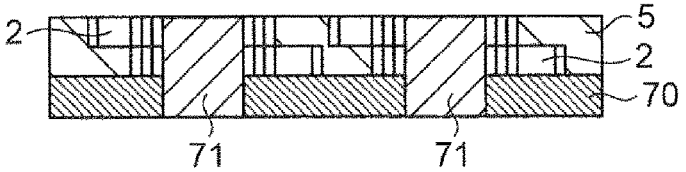

Next, as illustrated in FIG. 12A, a heat dissipative resin composite sheet 500 is press-fitted under heating from above the coil portions 2 such that, as illustrated in FIG. 12B, the heat dissipative resin composite 5 is arranged in a state surrounding the outer periphery of each of the coil portions 2. The heat dissipative resin composite sheet 500 can be fabricated by mixing predetermined amounts of the filler, the resin, and a solvent to form slurry, coating the slurry over a film with use of, e.g., a doctor blade, and drying the coated slurry.

Figure 12C:
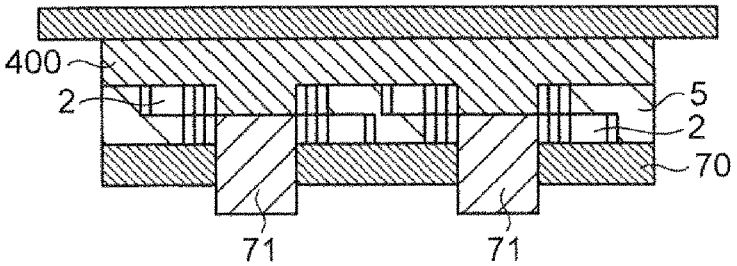
Figure 12D:
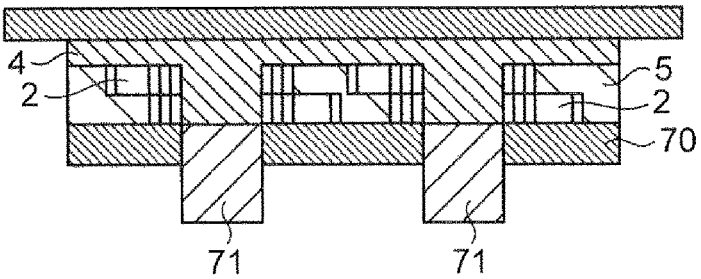

Next, as illustrated in FIG. 12C, a metal magnetic substance—resin composite sheet 400 is press-fitted under heating from above the coil portions 2 while the first positioning pins 71 and the second positioning pins 72 are withdrawn downward, such that, as illustrated in FIG. 12D, the metal magnetic substance—resin composite 4 is arranged in the core regions of the coil portions 2, the upper regions above the coil portions, and the connecting regions (not illustrated). The metal magnetic substance—resin composite sheet 400 can be fabricated by mixing predetermined amounts of the metal magnetic substance powder, the resin, and a solvent to form slurry, coating the slurry over a film with use of, e.g., a doctor blade, and drying the coated slurry.

Figure 12E:
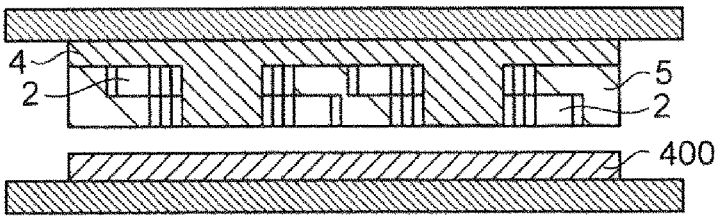
Figure 12F:
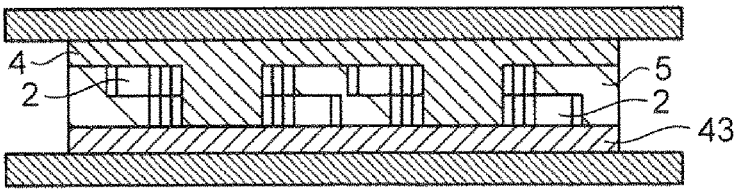

Next, as illustrated in FIGS. 12E and 12F, another metal magnetic substance—resin composite sheet 400 is press-fitted under heating to the lower regions 43 under the coil portions 2, thereby obtaining a block structural body.

The block structural body thus obtained is cut into pieces each having a predetermined size, and the core portions 3 each including the coil portion 2 with both the ends thereof exposed at the end surfaces of the core portion are obtained.

Thereafter, the first outer electrode 61 connected to one end of the coil portion 2 and the second outer electrode 62 connected to the other end of the coil portion 2 are formed on the end surfaces of the core portion 3. A method of forming the outer electrodes is not limited to a particular one, and a suitable method can be optionally selected depending on the purposes of uses. The first outer electrode 61 and the second outer electrode 62 may be formed, for example, by coating a conductive resin paste on the end surfaces of the core portion, and by thermally solidifying the coated conductive resin paste. The conductive resin paste can be prepared by mixing metal powder and resin. Alternatively, the first outer electrode and the second outer electrode may be formed by sputtering of a NiCr alloy or Ni plating. A metal film (e.g., a silver film or a Sn plating film) or an alloy film may be further formed on the first outer electrode. Similarly, a metal film (e.g., a silver film or a Sn plating film) or an alloy film may be further formed on the second outer electrode.

The coil component 1 according to the embodiment can be manufactured as described above.

EXAMPLES

Coil components of Examples 1 and 2 and Comparative Example 1 were fabricated in accordance with procedures described below. First, Composites 1 to 3 having compositions listed in Table 1, given below, were prepared. Composite 1 (metal magnetic substance—resin composite) was prepared by mixing a FeSiCr alloy having a medial diameter ($D_{50}$) of 20 μm and epoxy resin at proportions listed in Table 1. Composites 2 and (each being the heat dissipative resin composite) were prepared by mixing alumina and epoxy resin at proportions listed in Table 1. Respective thermal conductivities of Composites 1 to 3 are listed in Table 1. The thermal conductivities were measured by a laser flash method.

TABLE 1

| | FeSiCr Alloy (% by volume) | Alumina (% by volume) | Epoxy Resin (% by volume) | Thermal Conductivity (W/mK) |
|---|---|---|---|---|
| Composite 1 (metal magnetic substance-resin composite) | 95 | — | 5 | 2.6 |
| Composite 2 (heat dissipative resin composite) | — | 65 | 35 | 3.0 |
| Composite 3 (heat dissipative resin composite) | — | 75 | 25 | 9.0 |

Example 1

The coil component of Example 1 was fabricated in accordance with procedures described below. First, the forming die provided with, on its surface, the first positioning pins for positioning the coil portions and the second positioning pins for positioning the connecting regions was prepared, and the coil portions were inserted over the first positioning pins, respectively. A heat dissipative resin composite sheet fabricated by employing Composite 2 was press-fitted under heating from above the coil portions, whereby the heat dissipative resin composite was arranged in a state surrounding the outer periphery of each of the coil portions. The metal magnetic substance—resin composite sheet fabricated by employing Composite 1 was then press-fitted under heating from above the coil portions while the first positioning pins and the second positioning pins were withdrawn downward, whereby the metal magnetic substance—resin composite was arranged in the core regions of the coil portions, the upper regions above the coil portions, and the connecting regions. Another metal magnetic substance—resin composite sheet fabricated by employing Composite 1 was press-fitted under heating to the lower regions under the coil portions, whereby a block structural body was obtained. The obtained block structural body was cut into pieces each having a predetermined size, and the core portions each including the coil portion with both the ends thereof exposed at the end surfaces of the core portion were obtained. Thereafter, the first outer electrode connected to one end of the coil portion and the second outer electrode connected to the other end of the coil portion were formed on the end surfaces of each of the core portions. The coil component having the structure illustrated in FIGS. 1 to 6 was thus obtained.

Example 2

The coil component of Example 2 was fabricated in accordance with procedures similar to those in Example 1 except for using Composite 3 instead of Composite 2.

Comparative Example 1

The coil component of Comparative Example 1 was fabricated in accordance with procedures described below. The coil component of Comparative Example 1 was the coil component not including the heat dissipative resin composite. First, the metal magnetic substance—resin composite sheet containing the metal magnetic substance powder and the resin at the proportions as per listed in Table 1 was prepared. Then, the coil portion was placed in a die. The metal magnetic substance resin composite sheet was laid over the coil portion and was press-fitted under heating. Then, the metal magnetic substance resin composite sheet being integral with the coil portion was taken out from the die. A block structural body was formed by placing another metal magnetic substance—resin composite sheet over a surface of a taken-out product where the coil portion was exposed from the metal magnetic substance resin composite sheet, and by press-fitting the other metal magnetic substance—resin composite sheet under heating. The obtained block structural body was cut into pieces each having a predetermined size, and the core portions each including the coil portion with both of the ends thereof exposed at the end surfaces of the core portion were obtained. Thereafter, the first outer electrode connected to one end of the coil portion and the second outer electrode connected to the other end of the coil portion were formed on the end surfaces of the core portion. The coil component of Comparative Example 1 was thus obtained.

Furthermore, a value of inductance L and a value of direct-current resistance Rdc were measured for each of the coil components of Examples 1 and 2 and Comparative Example 1. Table lists the measurement results of the inductance L. As seen from Table 2, the inductances L of the coil components of Examples 1 and 2 and Comparative Example 1 had comparable values, i.e., about 3.3 μmH. Moreover, all the direct-current resistances Rdc of the coil components of Examples 1 and 2 and Comparative Example 1 had a value of 0.24Ω. As seen from the above-mentioned results, the coil components of Examples 1 and 2, each including the heat dissipative resin composite, is able to achieve an inductance value as high as that obtained with Comparative Example 1 not including the heat dissipative resin composite.

In addition, a current was superposed on each of the coil components of Examples 1 and 2 and Comparative Example 1, and a current value when a temperature of the coil portion increased by 40° C. from an ambient temperature (20° C.) as a reference (i.e., a current at ΔT=40° C.) was measured. Table 2 lists the measurement results.

TABLE 2

| | Inductance L (μH) | Current at ΔT = 40° C. (A) |
|---|---|---|
| Example 1 | 3.28 | 2.2 |
| Example 2 | 3.22 | 3.6 |
| Comparative Example 1 | 3.34 | 1.4 |

As seen from Table 2, the current values at ΔT=40° C. in the coil components of Examples 1 and 2, each including the heat dissipative resin composite, is higher than that in the coil component of Comparative Example 1, which does not include the heat dissipative resin composite. From the above result, it is understood that the heat dissipation characteristics of the coil component are improved with the provision of the heat dissipative resin composite, which at least partly connects the outer periphery of the coil portion and the end surface of the core portion to each other, and that a temperature rise in the coil portion can be suppressed. From comparing Examples 1 and 2, it is also understood that, in the coil component of Example in which the content of the filler (alumina) in the heat dissipative resin composite is 75% by volume, a higher current value at ΔT=40° C. is obtained than in the coil component of Example 1 in which the content of the filler is 65% by volume, and that the temperature rise in the coil portion can be further suppressed.

The coil component according to each of the preferred embodiments of the present disclosure can realize good heat dissipation characteristics and a high inductance value together, and it can be suitably used in a wide variety of applications including, e.g., an impedance element and an inductance element.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a coil portion;

a core portion in which the coil portion is buried;

a first outer electrode connected to one end of the coil portion at an end surface of the core portion; and a second outer electrode connected to the other end of the coil portion at an end surface of the core portion, wherein the core portion includes a metal magnetic substance—resin composite and a heat dissipative resin composite having a higher thermal conductivity than the metal magnetic substance—resin composite, the heat dissipative resin composite is arranged in a state surrounding an outer periphery of the coil portion and connecting the outer periphery of the coil portion and at least one of the end surfaces of the core portion in at least parts thereof, and the metal magnetic substance—resin composite is arranged in a core region of the coil portion, an upper region and a lower region above and under the coil portion, and a connecting region that connects the upper region and the lower region to each other in at least one corner of the core portion.

2. The coil component according to claim 1, wherein a horizontal cross-sectional area of the connecting region is not less than about 100% and not more than about 120% of a horizontal cross-sectional area of the core region.

3. The coil component according to claim 1, wherein the metal magnetic substance—resin composite contains powder of one or more types of metal magnetic substances selected from a group consisting of Fe, a FeSiCr alloy, a FeSi alloy, and amorphous FeSiCrB, and thermosetting resin selected from a group consisting of epoxy resin and urethane resin, or thermoplastic resin.

4. The coil component according to claim 1, wherein the metal magnetic substance—resin composite is arranged in the connecting regions that connect the upper region and the lower region to each other at four corners of the core portion.

5. The coil component according to claim 1, wherein a heatsink member is further arranged on at least one end surface of the core portion, the at least one end surface including the end surface connected to the outer periphery of the coil portion through the heat dissipative resin composite.

6. The coil component according to claim 1, wherein the heat dissipative resin composite contains one or more types of fillers selected from a group consisting of alumina and aluminum nitride, and one or more types of resin selected from a group consisting of epoxy resin and urethane resin.

7. The coil component according to claim 6, wherein a content of the filler in the heat dissipative resin composite is not less than about 50% by volume and not more than about 90% by volume.

* * * * *